US005207254A

United States Patent [19]

Fromm

[11] Patent Number: 5,207,254

[45] Date of Patent: May 4, 1993

[54] CONVERTIBLE HANDBAG

[76] Inventor: Thelma J. Fromm, 624 Sunrise Blvd., Prescott, Ariz. 86301

[21] Appl. No.: 797,363

[22] Filed: Nov. 25, 1991

[51] Int. Cl.[5] ..... A45C 3/08; A45C 13/02

[52] U.S. Cl. ..... 150/104; 150/109; 150/113; 190/110

[58] Field of Search ..... 150/103, 104, 105, 109, 150/110, 113; 383/111; 190/110

[56] References Cited

U.S. PATENT DOCUMENTS

| | | | |
|---|---|---|---|
| D. 164,621 | 9/1951 | Bienen | D87/3 |
| 1,978,971 | 10/1934 | Thornhill et al. | 150/28 |
| 1,990,360 | 2/1935 | Anish | 150/28 |
| 2,053,464 | 9/1936 | Dalsheim | 150/28 |
| 2,083,029 | 6/1937 | Lowy | 150/33 |
| 2,131,382 | 9/1938 | Lobel | 150/28 |
| 2,288,996 | 7/1942 | Dubilier | 383/106 |
| 2,436,237 | 2/1948 | Brandt | 229/87 |
| 2,653,640 | 9/1953 | Browning | 150/28 |
| 2,694,427 | 11/1954 | Hovis | 150/28 |
| 3,347,299 | 10/1967 | Alexander | 150/113 |
| 3,414,033 | 12/1968 | Tucker | 150/113 |
| 3,451,454 | 6/1969 | Davis | 150/104 |
| 3,963,102 | 6/1976 | Carp | 150/113 |
| 4,260,004 | 4/1981 | Domke | 150/113 |
| 4,263,951 | 4/1981 | Siegel | 150/113 |
| 4,463,789 | 8/1984 | Leiserson | 190/110 |
| 4,569,082 | 2/1986 | Ainsworth et al. | 150/113 |
| 4,718,524 | 1/1988 | Crumley | 150/113 |
| 4,754,790 | 7/1988 | Meyers | 150/104 |
| 4,811,769 | 3/1989 | Phares | 150/113 |
| 4,852,293 | 8/1989 | Levine et al. | 190/110 |
| 4,953,674 | 9/1990 | Landes | 150/105 |
| 5,005,679 | 4/1991 | Hjelle | 150/113 |
| 5,096,030 | 3/1992 | Espinosa et al. | 190/110 |

*Primary Examiner*—Gary E. Elkins

*Attorney, Agent, or Firm*—Don J. Flickinger; Jordan M. Meschkow; Lowell W. Gresham

[57] ABSTRACT

A handbag assembly is provided with separable inner and outer members which allow easy conversion into a variety of different styles and configurations. Specifically, the outer member comprises an envelope suspended from a carrying strap and having an open top closable by a conventional fastener. The inner member comprises a lining pouch sized to be closely received within the envelope. In one embodiment, the inner member is removably secured to the outer member by strips of hook and loop type fastening material which can also be used to seal the top edges of the inner member to one another when removed from the outer member.

8 Claims, 3 Drawing Sheets

FIG. 9
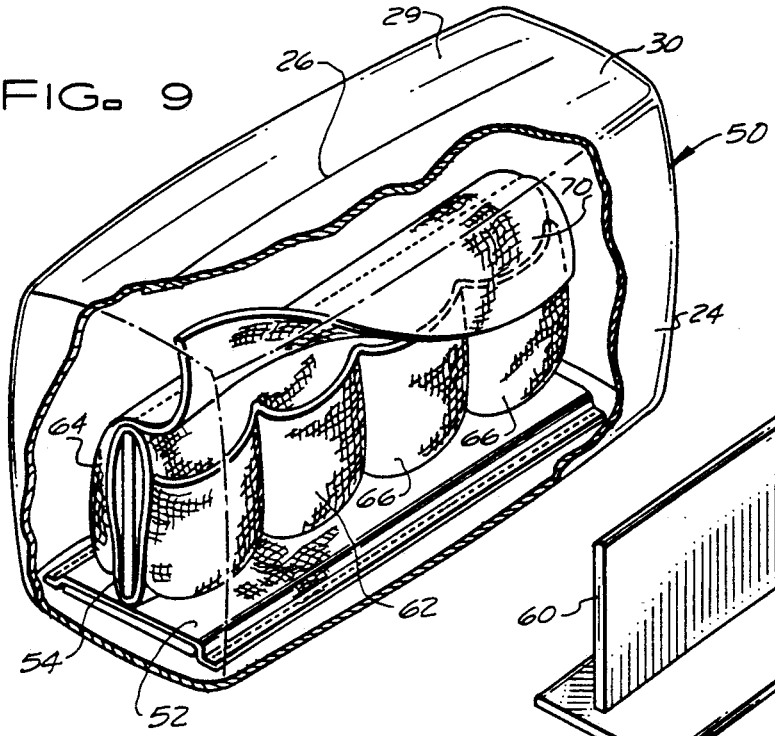
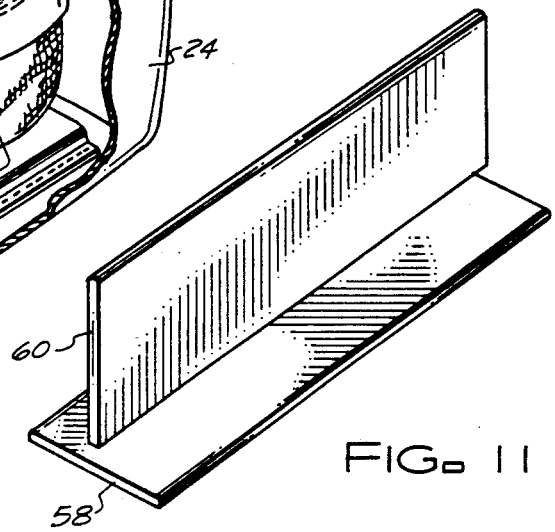
FIG. 11
FIG. 10
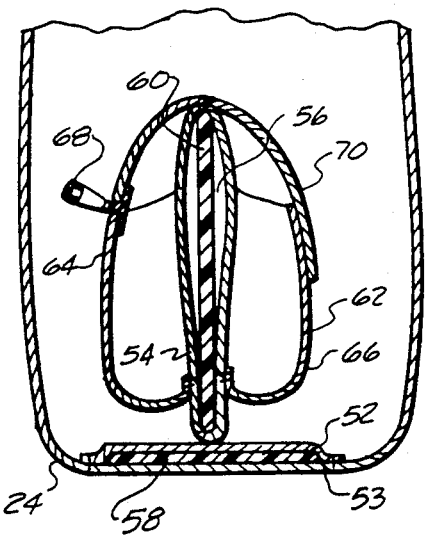
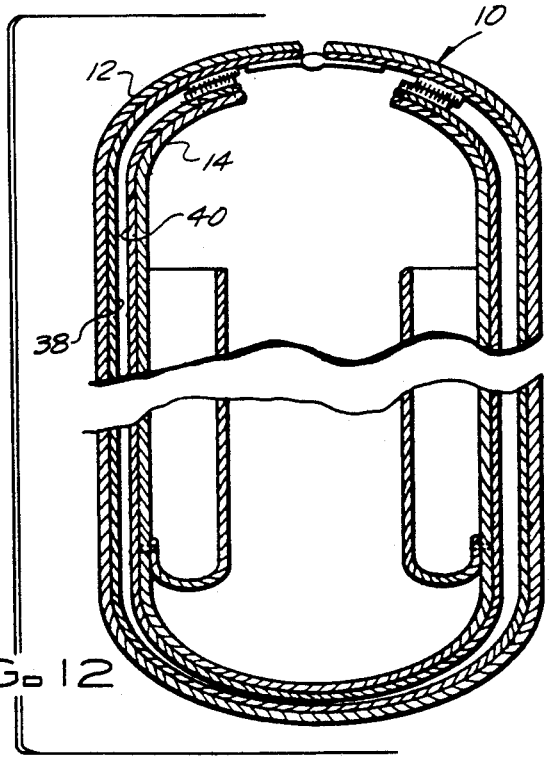
FIG. 12

CONVERTIBLE HANDBAG

BACKGROUND OF THE INVENTION

1. Field of the Invention

This invention relates to the art of women's clothing accessories.

More particularly, this invention relates to a handbag.

In a further and more specific aspect, the instant invention relates to an arrangement for converting a handbag to a variety of different styles and colors.

2. Description of the Prior Art

Handbags are considered an indispensable part of most women's wardrobes. The typical woman owns not one but many handbags, each in a different style and color, depending on the image the woman wishes to project at a particular time. For formal occasions, for instance, evening bags are available in relatively expensive materials such as silk or beaded fabrics. For business, leather bags are generally considered most appropriate. For casual, everyday use, women often favor purses constructed of less expensive fabrics and man-made materials. For sports, sturdier materials such as canvas and denim are often used.

A number of problems are associated with the ownership of multiple handbags. The high cost of purchasing the handbags is perhaps the most obvious problem. Another problem is that the same set of items must generally be transferred from bag to bag. This can be a time consuming process, particularly if the woman wishes to organize the items in an orderly fashion within each bag. If the woman does not wish to transfer all the items from one purse to another, but only a selected few, then she must hunt through the interior of the bag, which is usually dark, and often cluttered. In addition, a small amount of dirt and debris may accumulate in a bag over a certain period of time, and this may be inadvertently carried over to a new bag when the contents are transferred.

In response to the above problems, many prior art attempts have been made to provide handbags which are capable of being converted into a variety of different styles. A typical prior art convertible handbag consists a generally rigid frame or bag body, and an assortment of interchangeable covers of different colors and styles for securing over the frame. In many cases, the covers are made of rather limp or delicate, inexpensive materials such as paper, since they are strictly ornamental in function and do not provide any kind of supporting structure. In other cases, the covers are made of rigid materials which are difficult to launder. Furthermore, the arrangements for securing the covers to the frames have been generally unsatisfactory, making it difficult to quickly change from one style to another.

It would be highly advantageous, therefore, to remedy the foregoing and other deficiencies inherent in the prior art.

Accordingly, it is an object of the present invention to provide a handbag which can readily be converted into a number of different styles.

Another object of the invention is the provision of a handbag liner which can be simply and quickly inserted into and removed from interchangeable outer handbag covers.

And another object of the invention is to provide a set of interchangeable liners for inserting into an outer handbag cover.

Still another object of the invention is the provision of a lined outer handbag cover having sufficient strength to be usable with its lining removed.

Yet another object of the invention is to provide a handbag having an outer cover with a carrying strap and an inner liner with handles for facilitating its removal from the outer cover.

Yet still another object of the invention is the provision of a handbag liner having dual-purpose fasteners usable for both securing the liner to an outer cover and for securing the top edges of the liner to one another.

And a further object of the invention is to provide a handbag with means for easily inspecting the contents of the bag.

And still a further object of the invention is to provide a transferable handbag liner with means for expelling dirt and small debris.

And still yet another object of the invention is to provide a handbag liner having an upright support member for carrying a plurality of suspended pockets.

And yet another object of the invention is to provide separable inner and outer handbag members which can be easily laundered.

And still a further object of the invention is to provide a handbag, according to the foregoing, which is relatively inexpensive and easy to manufacture.

SUMMARY OF THE INVENTION

Briefly, to achieve the desired objects of the instant invention in accordance with the preferred embodiments thereof, a handbag assembly is provided with separable inner and outer members which allow easy conversion into a variety of different styles and configurations. Specifically, the outer member comprises an envelope suspended from a carrying strap and having an open top closable by conventional fastening means. The inner member comprises a lining pouch sized to be closely received within the envelope.

In one embodiment of the invention, continuous strips of hook and loop type fastening material are provided on either side of the lining pouch near its opening. These strips mate with corresponding strips provided on the inner surface of the outer envelope to fasten the lining pouch in place. The strips on the lining pouch also mate with one another to seal the pouch when it is removed from the outer envelope. Lifting straps are provided to facilitate removal of the pouch from the outer envelope.

In a further embodiment of the invention, the lining pouch contains a pocket structure generally resembling a saddlebag. The structure includes an upright support member, functioning as a bridge, and carrying a pocket portion on either side.

BRIEF DESCRIPTION OF THE DRAWINGS

The foregoing and further and more specific objects and advantages of the instant invention will become readily apparent to those skilled in the art from the following detailed description of preferred embodiments thereof taken in conjunction with the drawings in which:

FIG. 9 is a perspective view, with a portion broken away, of a lining pouch according to another embodiment of the invention;

FIG. 10 is a fragmentary sectional view of the lining pouch seen in FIG. 9;

FIG. 11 is a perspective view showing a stiffener assembly usable with the handbag assembly of FIGS. 9 and 10; and FIG. 12 is a sectional view, similar to FIG. 4, showing an alternate embodiment of the invention, with the outer envelope closed.

DETAILED DESCRIPTION OF THE PREFERRED EMBODIMENTS

Figure 1:
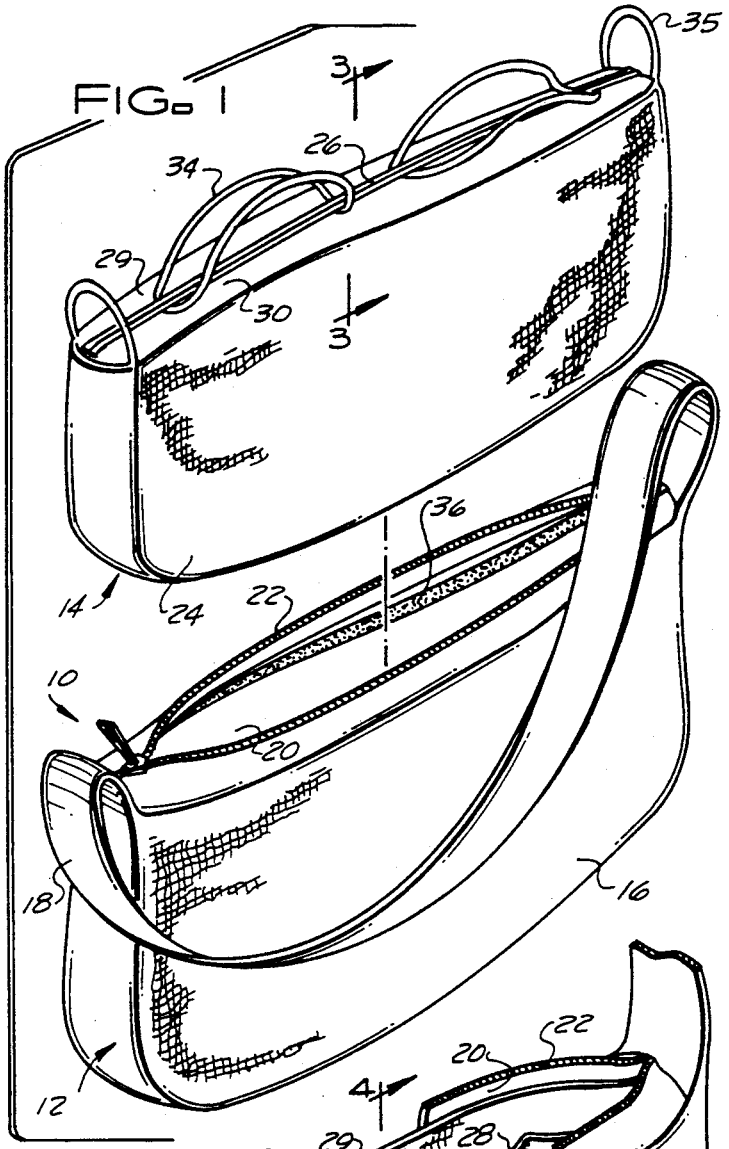
FIG. 1 is an exploded perspective view showing a handbag assembly according to a first embodiment of the present invention.

Turning now to the drawings in which like reference characters indicate corresponding elements throughout the several views, attention is first directed to FIG. 1, which shows a handbag assembly 10 of the present invention, consisting of an outer envelope 12 and a removable inner lining pouch 14.

The structure of the outer envelope 12, in general similarity to that of any conventional handbag, consists of an empty shell 16 suspended from a carrying strap 18. The shell 16 includes a top opening 20, which may be closed by a zipper 22 or other conventional fastener. The envelope 12 may be constructed of any conventional handbag material, although washable fabrics are preferred. If very large items are being transported, and there is no need for internal organizing pockets, the outer envelope 12 can be used alone, without the inner lining pouch 14.

On the other hand, when the user wishes to carry a large number of small items such as cosmetics and writing utensils, and to keep these items in a neatly arranged manner, the inner lining pouch 14 can easily be inserted into the envelope 12. The pouch 14 is in the form of a sack 24 sized to fit closely within the shell 16 of the outer envelope 12, but having a smaller top opening 26. A plurality of pockets 28 are provided on the inner surface of the sack 24, as best seen in FIGS. 2-7.

The top opening 26 of the inner lining pouch 14 is surrounded on both sides by a pair of flexible top edge walls 29, 30. A first strip of hook and loop type fastening material 31, such as that sold under the trademark "VELCRO", is secured to the outer surface of one of the edge walls 29, and a mating strip of fastening material 32 is secured to the outer surface of the other edge wall 30. In addition, a pair of lifting straps 34 is secured to each edge wall 29, 30 proximate the fastening strips 31, 32.

Figure 3:
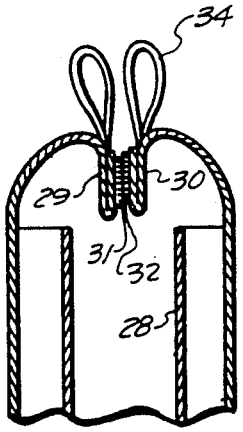
FIG. 3 is a sectional view taken through line 3—3 of FIG. 1.
Figure 2:
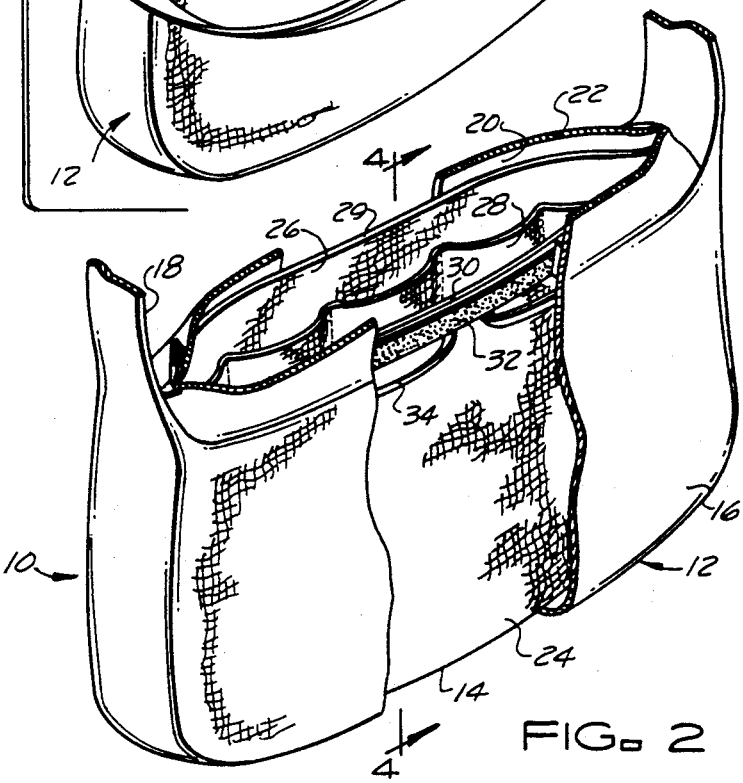
FIG. 2 is a perspective view of the handbag of FIG. 1, with portions broken away.

The flexibility of the top edge walls 29, 30 allows them to be turned inwardly and downwardly such that the fastening strips 31, 32 face one another and can be pressed into mating engagement to seal the lining pouch 14, as shown in FIG. 3. When the edge walls 29, 30 are turned downwardly, the lifting straps 34 extend upwardly, making it easy for a user to carry and store the lining pouch 14 and its contents independently of the outer envelope 12. To facilitate such independent use, the lining pouch 14 is also provided with a pair of D-loops 35 at opposite ends of the top opening 26. A conventional carrying strap (not shown) may be detachably connected to the D-loops when the lining pouch 14 is removed from the envelope 12.

Figure 4:
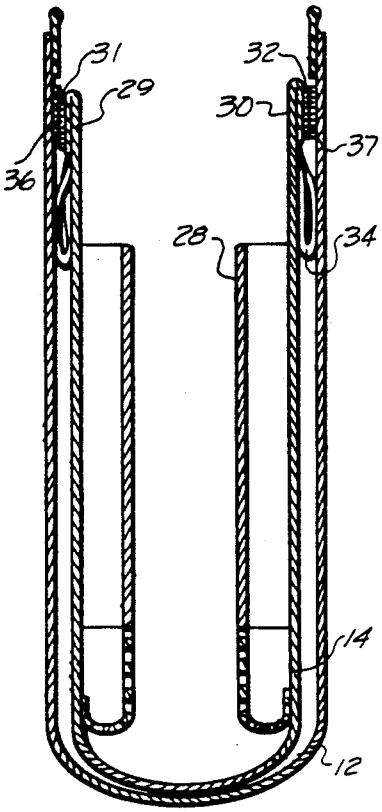
FIG. 4 is a sectional view taken through line 4—4 of FIG. 2.
Figure 5:
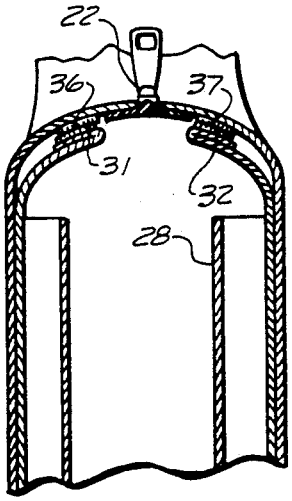
FIG. 5 is a fragmentary sectional view similar to FIG. 4, but with the outer envelope closed.

Alternatively, when the user wishes the lining pouch 14 to remain in the outer envelope 12, the edge walls 29, 30 may be turned upwardly and outwardly so that the fastening strips 31, 32 face away from one another and towards a second set of mating strips 36, 37 provided on the inner surface of the outer envelope 12. When the first set of strips 31, 32 is pressed into engagement with the second set of strips 36, 37, the inner lining pouch 14 is securely fastened to the outer envelope 12, as shown in FIG. 4. In this position, the lifting straps 34 extend downwardly into the envelope 12, discretely concealed from view. The arrangement keeps the top opening 26 of the inner lining pouch aligned with the top opening 20 of the outer envelope 12, so that both openings 20, 26 can be closed simultaneously by the zipper 22, as shown in FIG. 5.

Figure 6:
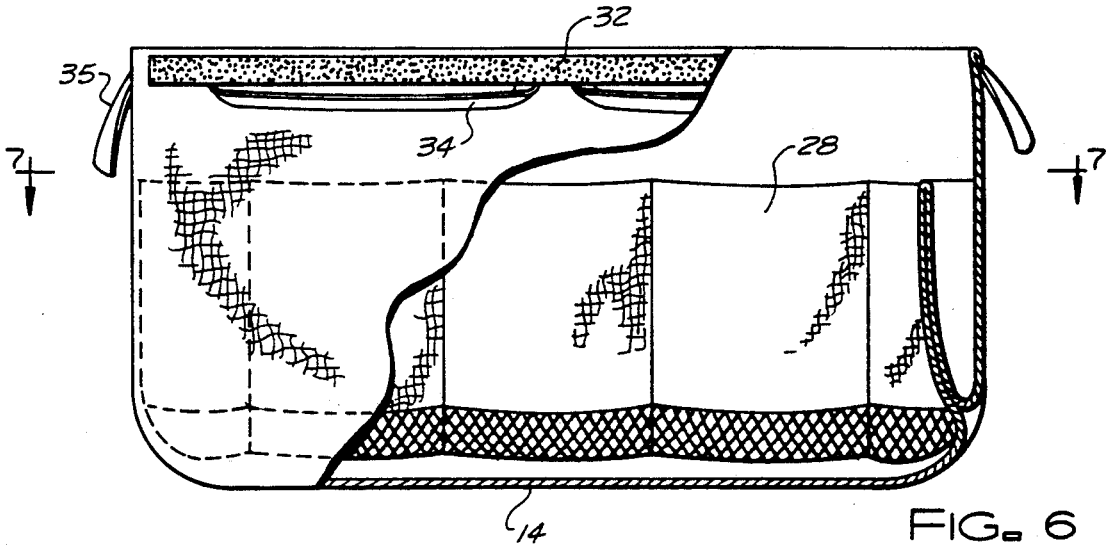
FIG. 6 is a front view of the inner lining pouch, with a portion broken away to show the interior.
Figure 7:
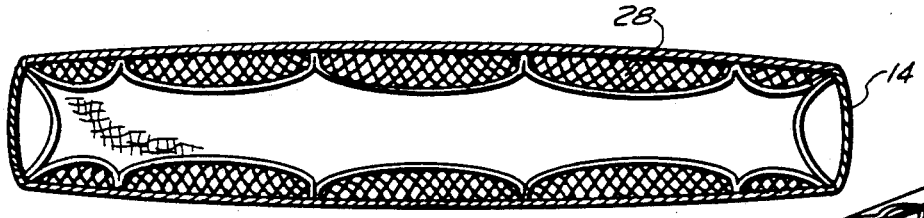
FIG. 7 is a sectional view taken through line 7—7 of FIG. 6.

The bottom portion of each of the pockets 28 of the lining pouch 14 is constructed from a mesh material, such as nylon netting, as best shown in FIGS. 6 and 7. The openings in the mesh allow the user to peer easily into the lining pouch 14, making it easier to locate small objects. In addition, any dust, lint or small particles will be readily removed during washing.

Figure 8:
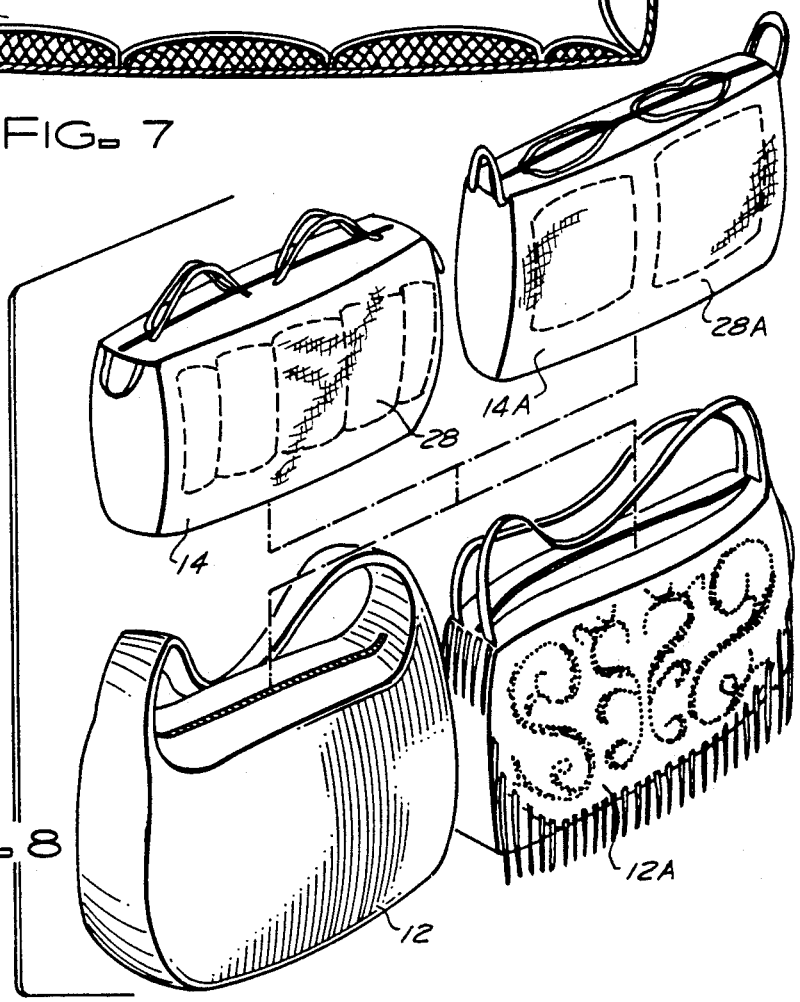
FIG. 8 is an exploded perspective view showing interchangeable envelopes and lining pouches usable with the handbag assembly of the present invention.

Just as the outer envelope 12 may be provided in various different styles and materials having different types of ornamentation, the inner lining pouch 14 may be provided with various arrangements of pockets. For example, FIG. 8 shows a set consisting of a rather plain outer envelope 12, a more elaborate envelope 12A, a first lining pouch 14 having many small narrow pockets 28, and a second lining pouch 14A having a smaller number of large wide pockets 28A. The simple envelope 12 may be for everyday use, while the more elaborate envelope 12A may be reserved for special occasions Similarly, the first lining pouch 14 may be an everyday liner filled with items for daily use, such as cosmetics, writing utensils, keys, and money, while the second lining pouch 14A may be filled with special purpose items such as baby bottles or beach paraphernalia. Thus, if a woman wants to switch from her everyday handbag to an evening purse, it is not necessary for her to transfer all the items individually from one bag to the other, but merely to lift the inner lining pouch 14 out of the everyday envelope 12 and transfer it into the more elaborate envelope 12A. Conversely, if she wants to keep the everyday envelope 12 but change its contents, she simply interchange the lining pouch 12A with lining pouch 12, again eliminating the need to remove items one by one.

Since each envelope 12, 12A and each lining pouch 14, 14A can be used alone as well as in combination with one of the other elements, the owner of the set shown in FIG. 8 has a selection of eight different handbag assemblies. This provides her with a greater degree of versatility at a far lower cost and more convenience than an equal number of conventional handbags.

The transfer of a lining pouch 14 into and out of an outer envelope 12 can take place quickly and easily if both the pouch 14 and the envelope 12 are made of relatively slick materials such as silk or satin. However, certain materials such as leather or denim may produce friction which makes it more difficult to remove the pouch 14 from the envelope 12. In such cases, it is desirable to provide a first layer 38 of low-friction material, such as satin, on the inner surface of the outer envelope 12, and a second layer 40 of low-friction material on the outer surface of the inner lining pouch 14, as shown in FIG. 12. In all other respects, the embodiment of FIG. 12 is identical to that of FIGS. 1–8.

FIGS. 9 and 10 illustrate an inner lining pouch 50 according to another embodiment of the invention. In general similarity to the previously described embodiments, the instant embodiment includes sack 24 having top opening 26 intermediate flexible top edge walls 29, 30. Although not specifically shown, pouch 50 may also include previously described fastening strips 31, 32, lifting straps 34 and D-loops 35.

A pocket structure, having the general appearance of a saddle bag, resides within pouch 50. The structure includes panel 52 overlying the bottom of pouch 50 and secured thereto along each longitudinal edge to form generally horizontal sheath 53. Sleeve 54, having a longitudinal edge secured to panel 52, extends upwardly therefrom to form upright sheath 56. Horizontal stiffening member 58 and upright stiffening member 60, as further seen in FIG. 11, are removably carried in sheath 53 and sheath 56, respectively. Preferably, panel 52 and sleeve 54 are fabricated of a flexible material, such as the cloth of which pouch 50 is made. The stiffening members 58, 60 are readily constructed of cardboard, plastic or other suitably rigid material.

Sleeve 54 functions as a bridge for supporting a first pocket portion 62 and a second pocket portion 64 on respective sides thereof. Each of the pouch portions may be variously configured. For purposes of illustration, pouch portion 62 is shown as comprising a plurality of individual pockets 66 while pouch portion 64 is shown as a single compartment accessible through zipper 68. Flap 70, depending from the upper edge of sleeve 54, extends over pocket portion 62. Pocket portion 62 and the section of pocket portion 64 residing below zipper 68 may be fabricated of mesh for purpose previously explained.

The foregoing arrangement of the inner lining pouch allows a user to store a number of small, relatively infrequently used objects, such as cosmetics, in a prearranged order in the pockets 68 of the inner lining pouch, while more frequently used objects, such as keys, can be casually tossed into the interior of the outer envelope 52, where they will not become entangled with the other items, and thus can be easily retrieved.

Various modifications and variations to the embodiments herein chosen for purposes of illustration will readily occur to those skilled in the art. To the extent that such variations and modifications do not depart from the spirit of the invention, they are intended to be included within the scope thereof which is assessed only by a fair interpretation of the following claims.

Having fully described and disclosed the instant invention and alternately preferred embodiments thereof in such clear and concise terms as to enable those skilled in the art to understand and practice the same, the invention claimed is:

1. A handbag assembly comprising:

a) an outer envelope having inner and outer surfaces and a top opening;

b) closure means secured to said outer envelope for closing said top opening;

c) an inner lining pouch removably carried in said outer envelope, said inner liner lining pouch having an open top and a pair of flexible top edge walls formed along opposite sides of said open top;

d) mating elements of a first detachable interconnection provided along said top edge walls of said inner pouch, said mating elements including i) a first fastener extending along one of said top edge walls, and ii) a second fastener extending along the other of said top edge walls; and e) mating elements of a second detachable interconnection provided on said inner surface of said outer envelope along opposite sides of said top opening, said mating elements including i) a third fastener, and ii) a fourth fastener, wherein said top edge walls of said inner lining pouch are foldable from a first position in which said first and second fasteners face outwardly for mating with said third and fourth fasteners, respectively, to secure said inner lining pouch to the inner surface or said outer envelope, to a second position in which said first and second fasteners face inwardly for mating with one another to seal said open top of said inner lining pouch.

2. A handbag a assembly according to claim 1, wherein said inner lining pouch includes at least one lifting strap for facilitating removal of said pouch from said envelope.

3. A handbag assembly according to claim 1, wherein said outer envelope includes a carrying strap.

4. A handbag assembly according to claim 2, wherein said outer envelope includes a carrying strap.

5. A handbag assembly according to claim 2, wherein said inner lining pouch includes connector means for detachably receiving a secondary carrying strap.

6. A handbag assembly according to claim 1, wherein each of said fasteners comprises a strip of hook and loop type fastening material.

7. A handbag assembly according to claim 1, wherein:

a) said inner surface of said outer envelope comprises a low-friction material; and b) said inner lining pouch comprises an outer surface formed of low-friction material, wherein said low-friction material of said lining pouch slides easily against said low-friction material of said outer envelope to facilitate insertion and removal of said lining pouch from said envelope.

8. A handbag assembly according to claim 1, wherein said inner lining pouch includes a mesh portion for allowing easy viewing of the contents of said pouch.

* * * * *